US008490283B2

(12) United States Patent
Keller et al.

(10) Patent No.: US 8,490,283 B2
(45) Date of Patent: Jul. 23, 2013

(54) HOLLOW-FIBER SPINNING NOZZLE AND METHOD

(75) Inventors: Torsten Keller, Hermeskeil (DE); Jens-Holger Stahl, Marpingen-Urexweiler (DE)

(73) Assignee: Fresenius Medical Care Deutschland GmbH, Bad Homburg (DE)

( * ) Notice: Subject to any disclaimer, the term of this patent is extended or adjusted under 35 U.S.C. 154(b) by 548 days.

(21) Appl. No.: 12/216,052

(22) Filed: Jun. 27, 2008

(65) Prior Publication Data

US 2008/0268082 A1 Oct. 30, 2008

Related U.S. Application Data

(63) Continuation of application No. 10/504,854, filed as application No. PCT/EP03/01447 on Feb. 13, 2003, now Pat. No. 7,393,195.

(30) Foreign Application Priority Data

Mar. 13, 2002 (DE) ..... 102 11 052

(51) Int. Cl.
*B29C 47/12* (2006.01)

(52) U.S. Cl.
USPC ..... 29/890.142; 29/527.1; 264/172.11; 264/177.14; 425/72.2; 425/131.5; 425/382.2

(58) Field of Classification Search
USPC ..... 29/428, 527.1; 264/172.11, 177.14; 425/131.5, 192 S, 382.2, 462, 463, 72.2; 57/244
See application file for complete search history.

(56) References Cited

U.S. PATENT DOCUMENTS

| | | | | |
|---|---|---|---|---|
| 2,815,532 | A * | 12/1957 | Braunlich | 425/463 |
| 3,081,490 | A * | 3/1963 | Heynen et al. | 425/463 |
| 3,341,891 | A * | 9/1967 | Shimizu et al. | 425/131.5 |
| 3,453,689 | A * | 7/1969 | Hume | 425/131.5 |
| 3,659,983 | A | 5/1972 | McLain et al. | |
| 3,686,377 | A | 8/1972 | Hays | |
| 4,229,154 | A * | 10/1980 | Chaban et al. | 425/72.2 |
| 4,411,852 | A * | 10/1983 | Bromley et al. | 264/172.17 |
| 5,320,512 | A | 6/1994 | Moore, Sr. | |
| 5,562,930 | A * | 10/1996 | Hills | 425/198 |
| 5,781,607 | A * | 7/1998 | Acosta et al. | 378/34 |
| 5,877,580 | A * | 3/1999 | Swierkowski | 310/328 |
| 5,989,004 | A | 11/1999 | Cook | |
| 6,391,673 | B1 * | 5/2002 | Ha et al. | 438/51 |
| 6,454,943 | B1 * | 9/2002 | Koenhen | 210/500.21 |
| 6,881,361 | B1 | 4/2005 | Schulze et al. | |
| 7,291,003 | B1 * | 11/2007 | Okandan et al. | 425/463 |
| 2002/0070476 | A1 | 6/2002 | Moore | |
| 2002/0070477 | A1 | 6/2002 | Moore | |
| 2002/0115002 | A1 | 8/2002 | Bailey et al. | |

FOREIGN PATENT DOCUMENTS

| | | |
|---|---|---|
| DE | 19926769 | 12/2000 |
| DE | 10027411 | 8/2001 |
| JP | 55090608 | 7/1980 |

(Continued)

*Primary Examiner* — Alexander P Taousakis
(74) *Attorney, Agent, or Firm* — Jacobson Holman PLLC

(57) ABSTRACT

A method of manufacturing a hollow fiber spinning nozzle in which supply bores and a nozzle structure connected to these and having a mass discharge opening and a needle with a coagulation agent bore are formed in a base body. At least two plate-shaped bodies structured by means of micro-structure technology are joined together to form the base body.

22 Claims, 4 Drawing Sheets

FOREIGN PATENT DOCUMENTS

| | | |
|---|---|---|
| JP | 63227808 | 9/1988 |
| JP | 04065505 | 3/1992 |
| JP | 2001254221 | 9/2001 |
| WO | WO 98/01705 | 1/1998 |

* cited by examiner

HOLLOW-FIBER SPINNING NOZZLE AND METHOD

RELATED APPLICATIONS

This application is a continuation of application Ser. No. 10/504,854, filed Aug. 27, 2004 now U.S. Pat. No. 7,393,195, which is a nationalization of PCT/EP03/01447, filed Feb. 13, 2003 and published in German, and hereby claims the priority thereof to which it is entitled.

BACKGROUND OF THE INVENTION

1. Field of the Invention

The invention relates to a hollow fiber spinning nozzle in which coagulation agent/support agent passages and mass supply passages and a nozzle structure connected to these and having a mass discharge opening and a needle with a coagulation agent/support agent bore are formed in a base body.

2. Description of the Related Art

Hollow fiber spinning nozzles are already known which serve the manufacture of polymeric hollow fiber membranes. As shown in FIG. 1 in accordance with the enclosed drawing, such hollow fiber spinning nozzles 10 consist of a base body 12 made of metal into which a plurality of bores 14, 16, 18, 22 have been introduced. A tube 20 has been fitted into the bore 14 and a coagulation agent passage or a support agent passage 22 has been formed therein for the introduction of the coagulation agent or support agent. The bores 16 and 18 form mass supply passages for a polymer which is discharged via a ring passage 22 which likewise consists of a corresponding bore. Methods of customary metal working are used in the manufacture of the known hollow fiber spinning nozzles 10. It is here therefore that the nozzle structure arises by the assembly of both nozzle parts, with any irregularity, for example in the geometry of the ring space 22 totalizing from the production errors on the production of the base body 12 and the tube 20. Furthermore, possible assembly errors also occur which can likewise result in an irregularity of the geometry. Finally, the hollow fiber spinning nozzles known from the prior art cannot be reduced to any desired size.

SUMMARY OF THE INVENTION

It is therefore the object of the invention to provide hollow fiber spinning nozzles with which fine capillary membranes can also be manufactured, with the production tolerances being minimized and the manufacturing process for these hollow fiber spinning nozzles being made much cheaper.

This object is solved in accordance with the present invention which is directed to a hollow fiber spinning nozzle in which coagulation agent/support agent passages and mass supply passages and a nozzle structure connected to these and having a mass discharge opening and a needle with a coagulation agent/support agent bore are formed in a base body which is constructed by the joining together of at least two plate-shaped bodies structured by means of microstructure technology. A completely innovative manner of construction is thus provided for hollow fiber spinning nozzles, since the invention moves away from conventional metal working and uses methods of microstructure technology. In accordance with the invention, at least two plate-shaped bodies structured by means of microstructure technology are namely assembled to form the hollow fiber spinning nozzle. A second non-structured plate is preferably joined onto a first plate formed by means of microstructure technology in this process, with the second plate only being structured after attachment to the first plate. The plates are really connected to one another. A plurality of advantages are opened up by the new production method. First, a substantially smaller dimensioning of the nozzle structure can be realized by means of microstructure technology. Moreover, a substantially higher precision can be realized with respect to the nozzle structure. This precision comes about in that the nozzle structure arises in one step. It is only restricted by the precision of the underlying lithography mask which is used in microstructure technology. Such lithography masks can, however, be produced extremely precisely with tolerances of 100 nm. A further advantage of the method in accordance with the invention lies in the substantially lower production costs of the spinning nozzles.

Special aspects of the invention are summarized in the following paragraphs.

Generally, all materials of microstructure technology can naturally be used for the realization of the hollow fiber spinning nozzles in accordance with the invention, provided they can be anisotropically etched and bonded. However, monocrystalline silicon, gallium arsenide (GaAs) or germanium can particularly advantageously be used.

In accordance with a particular embodiment of the invention, a hollow fiber spinning nozzle consists of two plates, with the mass supply passages, a mass flow homogenization zone, a coagulation agent/support agent supply bore and a needle stub being cut out in the first plate, while a nozzle structure having a mass annular gap and a needle with a coagulation agent/support agent bore being cut out in the second plate.

Alternatively, a design is also feasible in which the second plate additionally contains the mass supply passages and the mass flow homogenization zone. These elements and the needle stub are omitted on the first plate there. A particular feature of this design is that the needle of the spinning nozzle is only connected to the first plate at an end face.

These preferred aspects for a hollow fiber spinning nozzle, with which a simple capillary hollow fiber membrane can be manufactured, advantageously have the following dimensions:

| | |
|---|---|
| Thickness of the first plate: | 0.250-1.500 mm |
| Thickness of the second plate: | 0.050-1.500 mm |
| Outer diameter of the needle: | 0.020-1.500 mm |
| Length of the needle, incl. needle stub: | 0.100-2.000 mm |
| Diameter of the coagulation agent bore: | 0.010-1.000 mm |
| Length of the coagulation agent bore: | 0.150-2.500 mm |
| Outer diameter of the annular gap: | 0.040-3.000 mm |
| Length of the annular gap: | 0.050-1.500 mm |
| Height of the spinning nozzle: | 0.300-3.000 mm |
| Edge length of the spinning nozzle: | 1.000-25.00 mm. |

A further preferred aspect of the invention consists of three plates, with the first plate including supply passages, a homogenization zone and a needle stub with a central supply bore, a second plate which adjoins the first plate has supply passages, a homogenization zone and a further needle stub with a concentric ring passage and a needle extension, and wherein a third plate which in turn adjoins the second plate has a nozzle structure consisting of a central bore and two concentric annular gaps. Capillary membranes with co-extruded double layers can be manufactured by means of this hollow fiber spinning nozzle in accordance with the invention.

An alternative embodiment results in that the hollow fiber spinning nozzle is made up of three single plates, with the first plate having a central supply bore, a second plate adjoining the first plate having parallel supply passages and homogenization zones arranged with respect to these as well as a needle stub with a concentric ring passage and a central bore and with the third plate adjoining the second plate having a nozzle structure consisting of a central bore and two concentric annular gaps.

The outer diameter of the multi-passage hollow fiber spinning nozzle is advantageously smaller than 1 mm. The outer diameter of the multi-passage hollow fiber spinning nozzle is particularly advantageously smaller than or equal to 0.45 mm. A dialysis membrane with an inner diameter of 200-300 μm can be manufactured with this.

BRIEF DESCRIPTION OF THE DRAWINGS

Further details and advantages of the invention result from the embodiments shown in the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
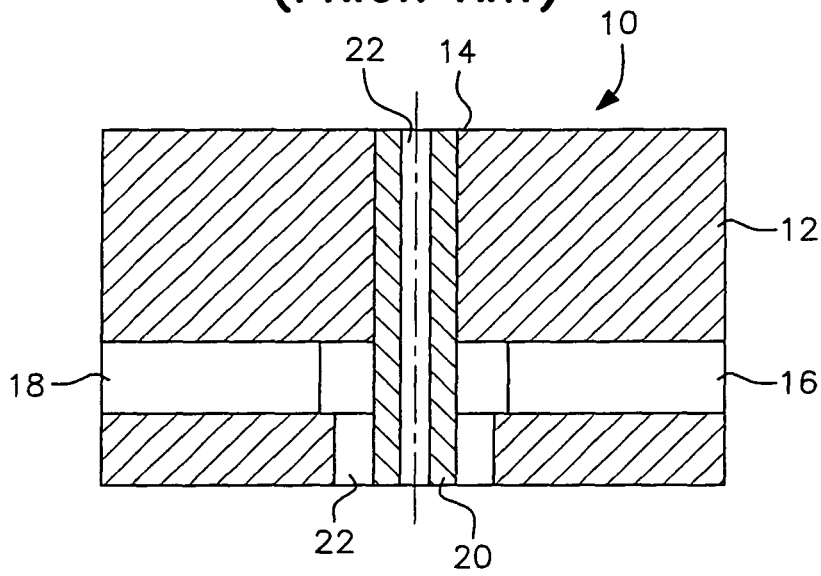
FIG. 1 (PRIOR ART)
FIG. 1 is a schematic section through a hollow fiber spinning nozzle in accordance with an embodiment in accordance with the prior art.
Figure 2:
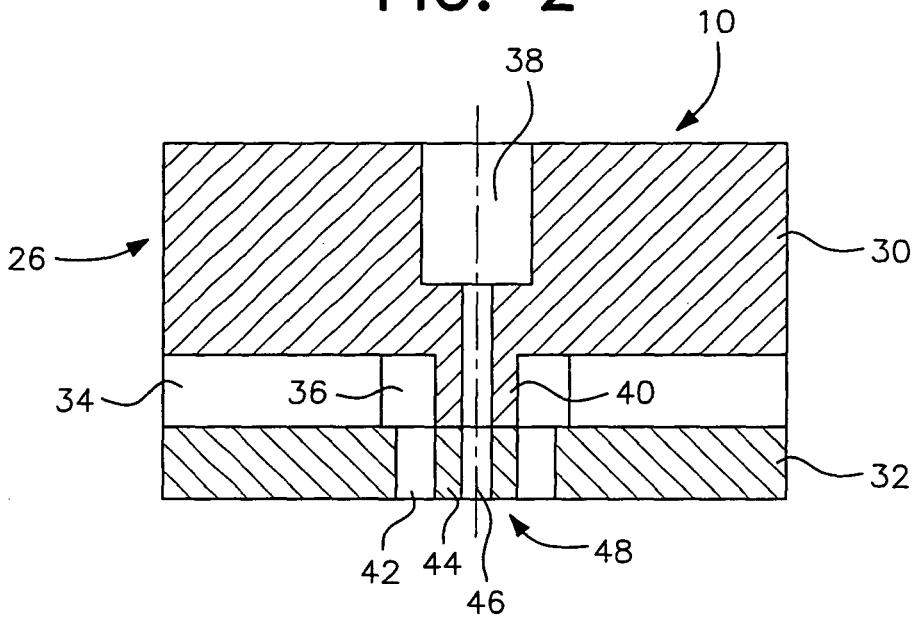
FIG. 2 is a schematic section through a hollow fiber spinning nozzle in accordance with a first aspect of the invention.

In FIG. 2, a hollow fiber spinning nozzle 10 in accordance with a first aspect of the invention is shown. Here, the total base body 26 is put together from two single plates 30 and 32. In the first plate 30, mass supply passages 34, a mass flow homogenization zone 36, a coagulation agent supply bore 38 and a needle stub 40 are formed by a corresponding etching process which will be described in detail later. The three-dimensional design of the hollow fiber spinning nozzle shown here in FIG. 2 results from FIG. 4. It can be seen there that the mass supply passages, i.e. the passages for the supply of the polymeric mass to be precipitated, are arranged in cross shape in the embodiment shown here. The mass flow homogenization zone 36 results as a ring space around the needle stub 40. The coagulation agent supply bore 38 is broadened in its region pointing toward the upper side, as can in particular be seen from FIG. 2.

Figure 4:
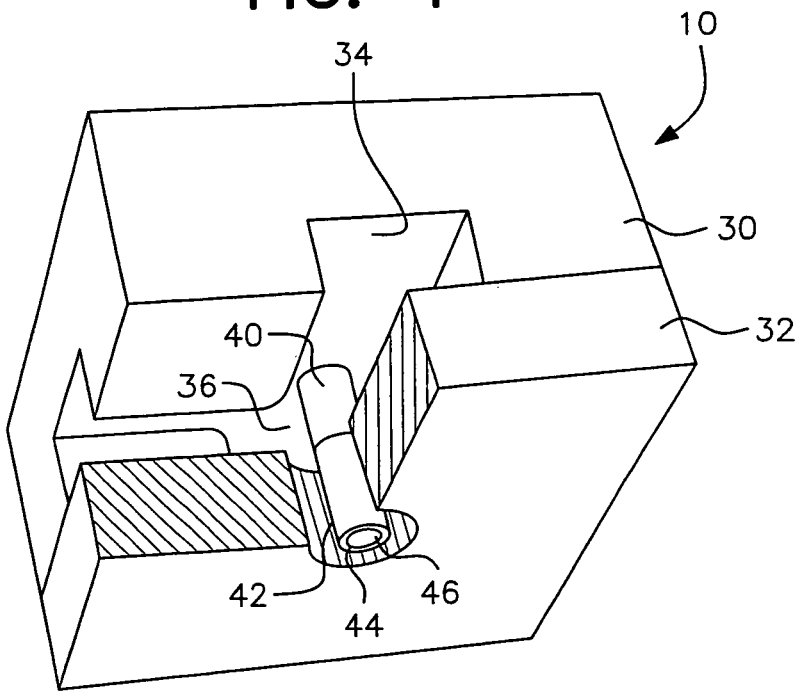
FIG. 4 is a partly sectioned three-dimensional representation of a hollow fiber spinning nozzle in accordance with FIG. 2.

The design of the second plate 32 can also be seen from FIGS. 2 and 4 which has a mass discharge opening 42 which directly adjoins the mass flow homogenization zone 36. This mass discharge opening or the mass annular gap 42 results, with the needle 44 with coagulation agent bore 46, in the high-precision nozzle structure 48. The embodiment shown in FIGS. 2 and 4 of mono-crystalline silicon has, for example, a thickness of the first plate of 0.4 mm, a thickness of the second plate of 0.1 mm, an outer diameter of the needle of 0.05 mm, a length of the needle including the needle stub of 0.15 mm, a diameter of the coagulation agent bore 38 in the expanded region of 0.1 mm, an outer diameter of the annular gap 42 of 0.1 mm and a length of the annular gap 42 of 0.1 mm. The height of the base body 26, i.e. the height of the total spinning nozzle 10, accordingly amounts to 0.5 mm, while an edge length of the base body 26 of the spinning nozzle 10 amounts to 2 mm.

In the manufacture of hollow fiber spinning nozzles by means of microstructure technology, 2 round wafer disks with diameters of 100 to 300 mm are the starting point. A plurality of spinning nozzle structures are simultaneously made from these wafers. The individual hollow fiber spinning nozzles 10 are then obtained by dividing the wafers already processed. The individual split spinning nozzles can each be given a single nozzle structure, as shown here, or also a plurality of nozzle structures in one nozzle structure compound. This is achieved in that not all nozzle structures formed on the wafer are separated from one another, but that a plurality of nozzle structures together form one multi-nozzle unit which are cut out from the wafer along their outer contour.

Figure 6:
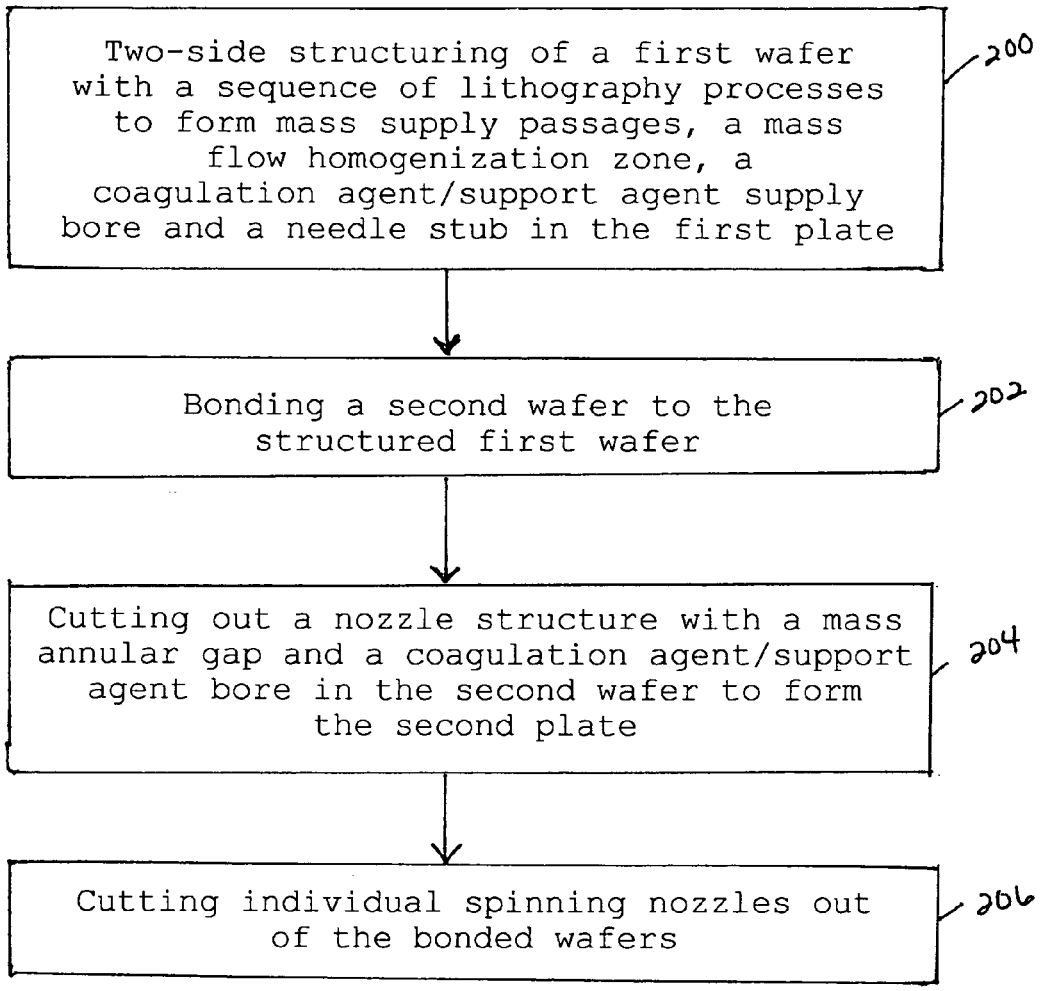
FIG. 6 is a flow chart summarizing a method of manufacturing a hollow fiber spinning nozzle in accordance with the present invention.

The manufacture of the spinning nozzles 10, as summarized in FIG. 6, starts with the two-side structuring of a first wafer which accommodates the elements 34, 36, 38, 40 of the plate 30 of the spinning nozzle 10, step 200. The structures are produced with a sequence of standard lithography processes, i.e. masks of photoresist, SiO, Si—N or similar, and standard etching processes. In the standard etching processes, in particular reactive ion etching (RIE), deep reactive ion etching (DRIE) and cryo-etching should be named. Specific deep etching processes such as DRIE and cryo-etching are particularly suitable. The lithography masks for the front side and for the rear side must be optically aligned to one another. Subsequently, the second wafer, from which the second plate should be manufactured, is bonded to the correspondingly structured first wafer, step 202. In this process, all bonding methods can be used, anodic bonding, direct bonding or similar. However, direct bonding is particularly suitable since the highest strengths are reached and thus a good hold of the needle on the first plate is ensured.

In the next step 204, the nozzle structure 48 with the annular gap 42 and the coagulation agent bore 46 are manufactured or cut out in a two-stage etching process to form the second plate. In the first stage, only the deeper coagulation agent bore is driven forward. In the second stage, both structures are then etch finished. Lithography processes and etching processes are again used, with the use of the deep etching process being more advisable here than in the working of the first wafer. In the final step 206, the individual spinning nozzles are, as already previously described, cut out of the bonded wafers by suitable separation processes such as wafer sawing or laser working.

Figure 5:
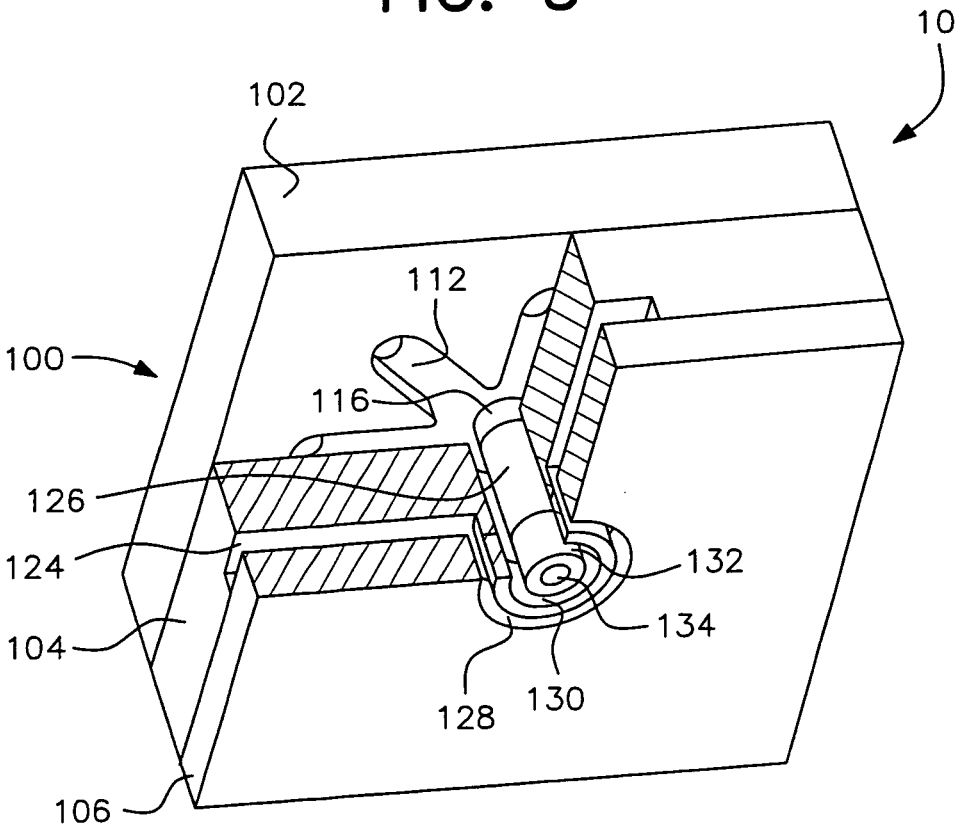
FIG. 5 is a partly sectioned three-dimensional representation of a hollow fiber spinning nozzle in accordance with the embodiment of FIG. 3*a*.

Further alternative aspects of the invention will be explained with reference to FIGS. 3 and 5. Here, a hollow fiber spinning nozzle 10 is shown for the manufacture of a hollow fiber co-extruded from two layers. Here, a hollow fiber spinning nozzle 10 is shown with a base body 100 consisting of three single plates 102, 104 and 106. The single plates in turn consist of mono-crystalline silicon. A supply passage 108 for the coagulation agent is cut out in the first plate. In addition, supply passages 110, 112 for a first polymer are provided which open into an associated homogenization zone 114. The homogenization zone 114 surrounds a corresponding needle stub 116.

Figure 3A:
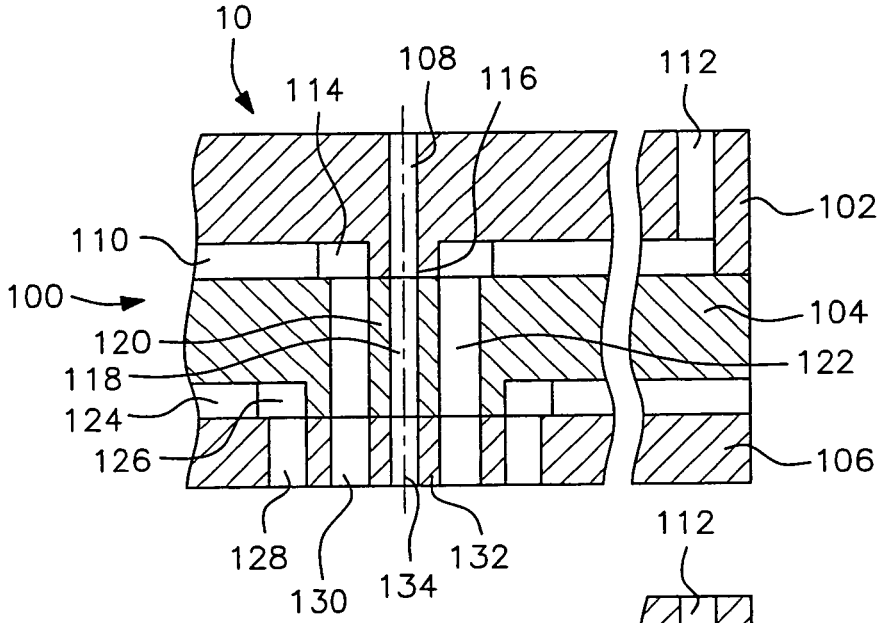
FIG. 3*a* is a schematic sectional representation of a hollow fiber spinning nozzle in accordance with a second embodiment of the invention, showing a first of three variants of the arrangement of the mass supply passages.
Figure 3B:
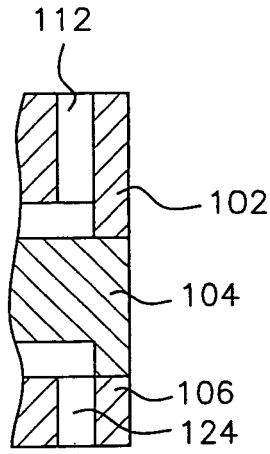
FIG. 3*b* is another schematic sectional representation of a hollow fiber spinning nozzle in accordance with the second embodiment of the invention, showing a second of three variants of the arrangement o the mass supply passages.
Figure 3C:
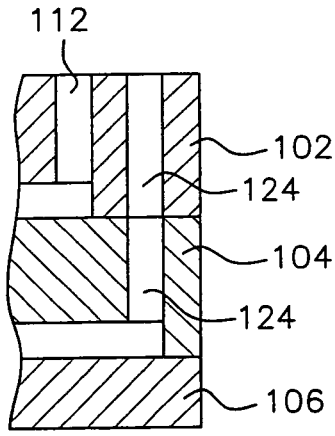
FIG. 3*c* is a further schematic sectional representation of a hollow fiber spinning nozzle in accordance with the second embodiment of the invention, showing the third of three variants of the arrangement of the mass supply passages.

A coagulation agent bore 118 is likewise cut out in the second plate 104 and is surrounded by a further needle stub 120 and by a ring space 122. Furthermore, further supply passages 124 are cut out in the second plate 104 with a subsequent homogenization zone 126. Finally, the third plate 106 has two annular gaps 128 and 130 for the respective polymeric materials which should be co-extruded as well as a needle 132 with a coagulation agent bore 134. In the variants of FIG. 3*a*, FIG. 3*b* and FIG. 3*c*, the supply passages 124 are each designed differently. While the supply passage 124 for the second polymer is only provided in the second plate 104 in the embodiment in accordance with FIG. 3*a*, it extends in the variant in accordance with FIG. 3*b* both through the second plate 104 and through the third plate 106. In the embodiment in accordance with FIG. 3*c*, the supply passage 124 for the second polymer extends through the second plate 104 and the first plate 102, as shown here in FIG. 3*c*. The representation in accordance with FIG. 5 corresponds to the section in accordance with FIG. 3*a*, with it becoming clear here that 8 supply passages 112 are arranged in star shape, while only 4 supply passages 124 are arranged in cross shape.

The three plates 102, 104 and 106 are in turn connected to one another to form the base body 100 by a suitable bonding process, advantageously by direct bonding. Otherwise, the manufacturing method for the hollow fiber spinning nozzle 10 in accordance with FIGS. 3 and 5 corresponds analogously to that as was already explained in detail with reference to FIGS. 2 and 4.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A method of manufacturing a hollow fiber spinning nozzle comprising the steps of:

structuring at least two plate-shaped bodies by means of microstructure technology to form a base body, said step of structuring starting with a plurality of wafer disks to make a plurality of spinning nozzle structures simultaneously; and forming coagulation agent/support agent passages and mass supply passages and a nozzle structure connected to said two plate-shaped bodies and having a mass discharge opening and a needle with a coagulation agent/support agent bore in said base body by means of microstructure technology.

2. The method of manufacturing a hollow fiber spinning nozzle in accordance with claim 1, wherein said step of forming a nozzle structure includes making a nozzle of monocrystalline silicon, gallium arsenide (GaAs) or germanium.

3. The method of manufacturing a hollow fiber spinning nozzle in accordance with claim 1, wherein said base body has two plates and said step of forming includes cutting out the mass supply passages, a mass flow homogenization zone, a coagulation agent/support agent supply bore and a needle stub in the first plate, and cutting out a nozzle structure with a mass annular gap and a needle with a coagulation agent/support agent bore in said second plate.

4. The method of manufacturing a hollow fiber spinning nozzle in accordance with claim 1, wherein said base body has two plates and said step of forming includes cutting out a coagulation agent/support agent supply bore in the first plate, and cutting out mass supply passages, a mass flow homogenization zone and a nozzle structure with a mass annular gap and a needle with a coagulation agent/support agent bore in said second plate.

5. The method of manufacturing a hollow fiber spinning nozzle in accordance with claim 1, further comprising the step of dividing the plurality of spinning nozzle structures to form individual hollow fiber spinning nozzles.

6. The method of manufacturing a hollow fiber spinning nozzle in accordance with claim 5, wherein the individual spinning nozzles are each given a single nozzle structure.

7. The method of manufacturing a hollow fiber spinning nozzle in accordance with claim 5, wherein the individual spinning nozzles are each given a plurality of nozzle structures in one nozzle structure compound.

8. The method of manufacturing a hollow fiber spinning nozzle in accordance with claim 7, wherein said plurality of nozzle structures in one nozzle structure compound is formed by not separating all of the nozzle structures formed on the wafer disks so as to form a multi-nozzle unit.

9. A method of manufacturing a hollow fiber spinning nozzle in which a coagulation agent/support agent supply bore, mass supply passages and a nozzle structure connected to these and having a mass discharge opening and a needle with a coagulation agent/support agent bore are formed in a base body formed by joining together at least a first plate and a second plate structured by means of microstructure technology, said method comprising:

two-side structuring of a first wafer to form mass supply passages, a mass flow homogenization zone, a coagulation agent/support agent supply bore and a needle stub in the first plate, said structuring being produced with a sequence of lithography processes;

bonding a second wafer to the structured first wafer;

cutting out a nozzle structure with a mass annular gap and a coagulation agent/support agent bore in the second wafer to form the second plate; and cutting individual spinning nozzles out of the bonded wafers.

10. The method as set forth in claim 9, wherein the step of structuring the first wafer includes masks of photoresists and etching processes.

11. The method as set forth in claim 10, wherein the etching processes include at least one of particular reactive ion etching, deep reactive ion etching and cryo-etching.

12. The method as set forth in claim 9, wherein said step of bonding includes at least one of anodic bonding and direct bonding.

13. The method as set forth in claim 9, wherein the step of cutting out the nozzle structure includes a two-stage etching process in which the coagulation bore is formed first, followed by the nozzle structure and annular gap.

14. The method as set forth in claim 13, wherein after said two-stage etching process the structures are etch finished using lithography processes and/or etching processes.

15. The method as set forth in claim 9, wherein said step of cutting out the individual spinning nozzles is performed by wafer sawing or laser working.

16. The method of manufacturing a hollow fiber spinning nozzle in accordance with claim 9, wherein said step of two-side structuring includes optically aligning lithography masks on both sides of said first wafer.

17. The method of manufacturing a hollow fiber spinning nozzle in accordance with claim 1, wherein said base body has a first plate, a second plate adjoining the first plate, and a third plate adjoining said second plate.

18. The method of manufacturing a hollow fiber spinning nozzle in accordance with claim 17, wherein said step of forming includes:

cutting out supply passages, a homogenization zone and a needle with a central supply bore in said first plate;

cutting out supply passages, a homogenization zone and a further needle stub with a concentric ring passage and a needle extension in said second plate; and cutting out a nozzle structure having a central bore and two concentric annular gaps in said third plate.

19. The method of manufacturing a hollow fiber spinning nozzle in accordance with claim 17, further comprising the step of dividing the plurality of spinning nozzle structures to form individual hollow fiber spinning nozzles.

20. The method of manufacturing a hollow fiber spinning nozzle in accordance with claim 19, wherein the individual spinning nozzles are each given a single nozzle structure.

21. The method of manufacturing a hollow fiber spinning nozzle in accordance with claim 19, wherein the individual spinning nozzles are each given a plurality of nozzle structures in one nozzle structure compound.

22. The method of manufacturing a hollow fiber spinning nozzle in accordance with claim 21, wherein said plurality of nozzle structures in one nozzle structure compound is formed by not separating all of the nozzle structures formed on the wafer disks so as to form a multi-nozzle unit.

* * * * *